US005227229A

United States Patent [19]

McMahan McCoy et al.

[11] Patent Number: 5,227,229

[45] Date of Patent: Jul. 13, 1993

[54] NONWOVEN POLYESTER ARTICLES AND METHOD OF MAKING SAME

[75] Inventors: Kay McMahan McCoy, Woodbury, Minn.; Kimberly K. Harmon, Hudson, Wis.; Mary B. Mallo, North St. Paul, Minn.

[73] Assignee: Minnesota Mining and Manufacturing Company, St. Paul, Minn.

[21] Appl. No.: 633,607

[22] Filed: Dec. 20, 1990

[51] Int. Cl.[5] ..... B05D 3/06; B24B 1/00; B24D 7/00; D06M 15/41

[52] U.S. Cl. ..... 428/283; 8/115.6; 15/28; 15/229.11; 51/295; 51/298; 51/400; 427/553; 428/288; 428/290; 428/395

[58] Field of Search ..... 428/480, 394, 245, 283, 428/288, 290, 395; 522/141, 146; 8/115.6; 427/553

[56] References Cited

U.S. PATENT DOCUMENTS

| | | | |
|---|---|---|---|
| 2,940,869 | 6/1960 | Graham | 522/141 |
| 2,958,593 | 11/1960 | Hoover et al. | 51/295 |
| 3,101,275 | 8/1963 | Cairns et al. | 522/141 |
| 3,360,448 | 12/1967 | Schneider et al. | 428/480 |
| 3,642,518 | 2/1972 | Miki et al. | 117/72 |
| 3,849,166 | 11/1974 | Omichi et al. | 117/47 |
| 4,051,302 | 9/1977 | Mayama et al. | 428/411 |
| 4,190,623 | 2/1980 | Bobeth et al. | 522/144 |
| 4,594,262 | 6/1986 | Kreil et al. | 427/44 |
| 4,794,041 | 12/1988 | Gillberg-LaForce | 428/394 |
| 4,810,567 | 3/1989 | Calcaterra et al. | 428/224 |

FOREIGN PATENT DOCUMENTS

| | | |
|---|---|---|
| 81-0043410 | 1/1982 | European Pat. Off. . |
| 81-102812 | 7/1985 | European Pat. Off. . |
| 48-018584 | 3/1973 | Japan . |
| 55-151028 | 11/1980 | Japan . |
| 60-70712 | 4/1985 | Japan . |
| 63-120775 | 5/1988 | Japan . |
| 1-256583 | 10/1989 | Japan . |
| 1196242 | 12/1985 | U.S.S.R. . |
| 1149812 | 4/1969 | United Kingdom . |
| 1228173 | 4/1971 | United Kingdom . |

OTHER PUBLICATIONS

Pacifici and Straley, Journal of Polymer Science, vol. 7, 1969 at pp. 7–9.

Owens, "The Mechanism of Corona and Ultraviolet Light-Induced Self-Adhesion of Poly(ethylene terephthalate)", Journal of Applied Polymer Science, vol. 19, 1975 at pp. 3315–3326.

*Primary Examiner*—James C. Cannon

*Attorney, Agent, or Firm*—Gary L. Griswold; Walter N. Kirn; Jeffrey L. Wendt

[57] ABSTRACT

Surface-finishing articles comprising a lofty, nonwoven, three-dimensional web of polyester fibers coated with a phenol-formaldehyde resin binder. The polyester fibers are exposed to UV radiation prior to being coated with the resin binder A pretreatment of hydrogen peroxide may also be employed

8 Claims, No Drawings

NONWOVEN POLYESTER ARTICLES AND METHOD OF MAKING SAME

BACKGROUND OF THE INVENTION

1. Field of the Invention

This invention relates to nonwoven surface finishing articles comprising a three-dimensional web of polyester fibers which are bonded together with a phenol-formaldehyde resin. The invention also relates to a method of making the articles involving UV irradiation of the polyester fibers before application of the bonding resin.

2. Description of Related Art

Nonwoven, three-dimensional, fibrous, abrasive products have been employed to remove corrosion, surface defects, burrs and impart desirable surface finishes on various articles of aluminum, brass, copper, steel, wood and the like. Nonwoven, three-dimensional fibrous products made according to the teaching of U.S. Pat. No. 2,958,593 have been widely used for some time. Typically, a nonwoven, three-dimensional web of fibers is coated with a resin. The resin may optionally contain an abrasive Many combinations of staple fibers, resinous binders, and optional abrasive particles have been employed in these products. One particular fiber and resin combination which has gained widespread use is nylon 6 or 66 fibers with thermoset phenol formaldehyde resins coated thereon. However, a drawback of using nylon fibers in surface finishing products is the relatively high cost of nylon as a fiber. A less costly alternative to a nylon fiber is a polyester fiber. However, a surface finishing article employing a combination of a polyester fiber with a phenol-formaldehyde resin has not been commercially feasible due to the resin not adhering well to the polyester fiber, thus, resulting in a surface finishing article having insufficient strength and durability.

The combination of polyester fibers with other binders such as epoxy resins, as described in U.S. Pat. No. 2,958,593, have very good performance, but the epoxy binders are significantly more costly than phenolic resin binders and are highly reactive systems which are more difficult to process than phenolic resins. Furthermore, the epoxy binders are difficult to recycle in the manufacturing process as compared to formaldehyde resin binders. Further, epoxy resin residue is very difficult to clean up from processing equipment once it hardens and, thus, results in considerable downtime of equipment during clean up.

U.S. Pat. No. 4,794,041 describes a method for activation of polyethylene terephthalate material, such as fibers used in tire yarns, to provide enhanced adhesion to adhesives such as epoxy or isocyanate materials. The polyester material is activated by an electron beam source, which is believed by the patentee to activate the material by promotion of free radicals to generate carboxyl and hydroxyl functions. This treated surface, particularly when used in tire cords, is coated with a resorcinol-formaldehyde resin, modified-rubber latex, prior to incorporation of the fiber into tire bodies.

There are references teaching exposing polyester fibers to UV radiation to enhance adhesion to various binders. The references describe processes in which polyester fibers are subjected to high intensity UV radiation for relatively-short periods of time resulting in improved adhesion to adhesives and epoxy resins. Great Britain Pat. No. 1,228,173 (1971) describes UV treatment of polyester textile materials which is done in the presence of air or other gases. The treatment is done with relatively low intensity radiation, followed by coating the treated fibers with formaldehyde-containing adhesives. The principal objective of the treatment is to prepare polyester fibers for incorporation into rubber tire bodies.

U.S. Pat. No. 4,594,262 describes polyester film which is subjected to electron-beam radiation while passing through an inert atmosphere, such as nitrogen, to produce a surface having improved bonding to organic coatings. Great Britain Pat. No. 1,149,812 (1969) describes the UV treatment of polyester film suitable for use in photographic applications, where the polyester film is exposed to ultraviolet radiation during the biaxial stretching or the thermal setting process. The treated film has improved adhesion to coatings used in photographic film applications.

EP 81-0,043,410 (laid open Jan. 13, 1982) describes a method for priming polyester yarn with UV radiation and thereafter coating the yarn with a silane of the glycidoxy type, where the silane is applied to the fiber before or immediately after the UV radiation. After the priming step is completed, the fiber is treated with a non-ammoniated resorcinol formaldehyde latex dip. The resultant primed and coated polyester fibers are then useful for incorporation into tire cords EP 81-102,812 (laid open Jan. 13, 1982) describes a process for treating polyester fiber to enhance adhesion. The process subjects the polyester fiber to UV radiation after drawing the fiber. A fiber finish consisting of a silane, which is preferably a gamma-glycidoxy-trimethoxy-propyltrimethoxysilane, is also applied to the fiber.

The use of peroxide solutions to enhance adhesion to polyester films has been demonstrated. U.S. Pat. No. 4,051,302 describes a method of improving adhesion to polyester film surfaces where the polyester is coated with both an aqueous hydrogen peroxide solution and a hydrophilic polymer and, thereafter, the coated polyester is radiated with UV while the surface is still wet. U.S. Pat. No. 3,849,166 describes a method of generating a hydrophilic surface on polyethylene terephthalate film for photographic applications, where the film is first wet with an aqueous solution containing hydrogen peroxide and a water miscible solvent, and then the film is exposed to UV radiation while the surface was wet. U.S. Pat. No. 3,360,448, describes treating polyester film surfaces first with hydrogen peroxide followed by UV radiation for the purposes of enhancing wetability of the polyester surface to photosensitive materials.

To date, there has not been a surface finishing article which utilizes a combination of polyester fiber and a thermoset phenol-formaldehyde resin suitable for use in applications demanding high structural integrity and durability. Surface finishing articles have unique requirements of flexibility and durability which have not been addressed or solved to date by the prior art. There has also not been a method employing UV treatment of polyester fibers for use in surface finishing articles.

SUMMARY OF THE INVENTION

The present invention provides a surface finishing article and a method of making the surface finishing article. The article utilizes a fiber/resin combination of polyester and phenol-formaldehyde which results in a low cost, strong, durable surface finishing article.

The present invention is a nonwoven, three-dimensional, open, lofty web of polyester fibers. The fibers have been exposed to a dosage of at least about 200 mJ/cm$^2$ of UV radiation. The web also has a phenol-formaldehyde resin which substantially bonds the fibers at points of mutual contact.

The present invention also provides a method of making a nonwoven, three-dimensional, open, lofty web comprising polyester fibers coated with a phenol-formaldehyde resin. The method comprises the steps of:

(a) providing a lofty, open, three-dimensional, nonwoven fiber web wherein the fibers consist essentially of polyester selected from the group consisting of polyester, having a dulling agent blended thereon, and polyester which is substantially free of dulling agent;

(b) treating the nonwoven fiber web with an aqueous solution of hydrogen peroxide at least if the polyester has no dulling agent blended therein;

(c) exposing the nonwoven fiber web to UV radiation at an exposure dosage of at least 200 mJ/cm$^2$;

(d) coating the UV-exposed, nonwoven fiber web with a coating composition which, on curing, results in a poly(phenol-for-aldehyde) resin which substantially bonds said fibers at points of mutual contact; and (e) curing the coating composition.

DETAILED DESCRIPTION OF THE INVENTION

This invention provides an open, lofty web of polyester fibers which can be securely bonded to hard resinous binders, such as thermoset phenol-formaldehyde resins, without the need for intermediate bonding agents or priming adhesives. The fibers of this invention are useful for abrasive products, such as the lofty, nonwoven abrasive structures described by However et al. in U.S. Pat. No. 2,958,593. In these nonwoven abrasive products, the bond strength between the fiber matrix and the adhesive, which optionally contains a variety of abrasive materials, is very important. Bond failure, particularly in the presence of cleaning agents, causes these lofty, nonwoven abrasive products to prematurely flatten and/or disintegrate when subjected to the stresses of ordinary use.

Phenol-formaldehyde resinous binders have been used as binders for nonwoven, low-density, abrasive products containing nylon fibers. However, nylon fibers are significantly more costly than polyester fibers. It has been found that a wear-resistant, low-density, nonwoven product can be manufactured where the product comprises polyester fibers which have been possibly coated with hydrogen peroxide, thereafter exposed to UV radiation, and coated with a thermoset base catalyzed phenol-formaldehyde resinous binder.

The process for the present invention requires the formation of a nonwoven web utilizing polyester fibers. The fibers are preferably crimped. Fibers found satisfactory are about 35 to about 90 mm, preferably about 38 to about 50 mm in length and have a denier of about 10 to 100, preferably about 15 to 50. The nonwoven web is readily formed on a "Rando Webber" machine (commercially available from Curalator Corporation) or may be formed by other conventional web-forming processes, such as carding.

When hydrogen peroxide pretreatments are employed, the fibers are preferably roll coated with an aqueous solution of hydrogen peroxide to lightly wet the fibers. It is preferred the aqueous solution has a hydrogen peroxide concentration of about 3–50% by weight. Hydrogen peroxide solutions suitable for the present invention are available from Mallinckrodt, Inc.

The next step involves the irradiation of the web by UV radiation. If a hydrogen peroxide treatment has used, the fibers are UV irradiated while still wet with hydrogen peroxide. The web is then passed through a UV processor apparatus. The UV source preferably has two lamps to irradiate each side of the web. Preferably, the web is irradiated with a dosage of 200–1000 mJ/cm$^2$, most preferably, with a dosage of 200–800 millijoules per cm$^2$. The web is thereafter transferred out of the UV apparatus and impregnated with either a resin binder or a resin-abrasive slurry using a 2-roll coater to thoroughly wet the fibers. Other methods of applying the resin may also be employed. The resin is thereafter cured, preferably thermally cured.

In the present invention, the preferred polyester fibers are crimped polyethylene terephthalate fibers commercially available from Hoechst Celanese Corp. under the designation "294." Other fiber-forming polyesters, such as polybutylene terephthalate fibers and other aromatic ring-containing polyesters, would be feasible for use in the present invention.

In the present invention, the preferred resinous binders are thermoset phenol-formaldehyde resins. These resins provide outstanding environmental resistance, temperature resistance, and are comparatively less expensive than other resins, such as epoxy resins, polyurethane resins, polyisocyanurate resins, and the like. The most preferred resin is a base-catalyzed phenol-formaldehyde resin, having a phenol-formaldehyde mole ratio of 1:1.9 (70% solids).

During the melt extrusion and processing of the individual thermoplastic fibers, the use of process finishes, sometimes in almost undetectable amounts, might be necessary to lubricate the fiber and control static electricity. Without these process finishes, many fiber processing steps would be nearly impossible, and weaving or nonwoven web-forming would not be possible on a commercial scale. Dull polyester fibers generally contain about 0.2–2% by weight of delustering agent, with titanium dioxide being commonly used.

It has been found that fiber process finishes may be used in the fibers of the present invention but are not required. Fiber process finishes are typically applied during the fiber-melt spinning and orientation process. Fiber finishes are generally a blend of lubricants, antistats, and emulsifiers. Lubricants can be natural mineral oils and waxes, vegetable oils and waxes (triglycerides), and animal oils. Lubricants can also be synthetic esters, ethoxylated esters, ethoxylated fatty acids, ethoxylated fatty and synthetic alcohols, polyethers, synthetic waxes, and silicones.

Antistatic agents can be broken into four types. The first is anionic, which includes alkyl acid phosphates and salts (metals, alkanolamines), ethoxylated derivatives of the above materials, phosphated ethoxylates of fatty acids and alcohols, and organic sulfates and sulfonates. The second is cationics, which include quaternary ammonium, pyridinium, imidazolinium, quinolinium compounds, such as chlorides, metho- and ethosulfates, and alkyl amine oxides. The third is amphoterics, such as betaines The fourth is nonionics, such as ethoxylated fatty acids, amides, and polyether compounds.

Emulsifiers are generally broken down into four types. The first is anionic, which includes fatty acid soaps (metals, alkanolamines), sulfated vegetable oils, alkane sulfonates, alkyl sulfosuccinate salts, and ethoxylated alkyl phosphate salts. The second is cationic, which includes fatty amines, ethoxylated fatty amines, quaternary ammonium compounds, and ethoxylated quaternary compounds. The third is nonionic, which includes polyglycols, polyglycol esters and ethers, glyceryl fatty acid esters, ethoxylated alcohols, fatty acids, fatty amides, and alkyl phenols. The fourth is amphoterics, which includes amino acids and their salts, and betaines A preferred finish comprises a mixture of nonionic surfactants and cationic quaternary compounds. Examples of possible nonionic surfactants include polyethylene glycol esters and fatty acid esters. Examples of cationic quaternary compounds include quaternary ammonium ethyl sulfate and ethoxylated amine quaternary compounds.

Pretreatment of the polyester fibers prior to exposure to UV radiation with an aqueous hydrogen peroxide solution may or may not be required, depending on the type of fiber finish used, and/or whether a bright or dull fiber was used. The use of a peroxide pretreatment can enhance adhesion of phenol-formaldehyde resin to the polyester fibers, as well as allow a wider range of UV exposure intensities (with the lower limit on intensity being about 200 mJ/cm$^2$) to achieve acceptable adhesion and durability of the resultant nonwoven low density abrasive products.

FIBER BREAKAGE TEST

This test procedure evaluated the adhesion of phenolic resin to a 50 denier per filament (dpf) monofilament fiber. The test procedure recorded bead force and whether the bead force resulted in fiber breakage or resin slippage.

A cardboard sample holder, approximately 0.6 mm thick, 100 mm in length and 25 mm in width, had an approximately 20 mm circular hole cut out in its center. A single 50 dpf fiber, approximately 150 mm long, was secured in the long direction at the center of the cardboard, using a pressure-sensitive cellophane tape commercially available under the trade designation "Scotch Brand Tape 610" from Minnesota Mining and Manufacturing Company (3M). A single drop of a base-catalyzed thermoset phenol-formaldehyde resin, manufactured by 3M, was placed on the fiber at approximately the center of the opening of the cardboard. This liquid resin droplet was approximately 0.08–0.14 millimeters in diameter. The cardboard holder, fiber, and resin droplet were subjected to heating until the phenolic resin bead cured. The heating cycle consisted of first heating to 100° C. for 45 minutes, followed by 30 minutes at 175° C. in a heated air oven. After curing the resin on the fiber, the fiber diameter on both ends of the bead, as well as the size of the bead, were measured with a microscope fitted with a micrometer eyepiece.

One end of the sample holder was fastened to the top jaw of a Sintech tensile tester. Carefully, the sides of the cardboard support holder were cut to remove approximately 12 mm of cardboard adjacent to the center hole so as to free the ends of the cardboard fiber holder. A metal fixture, which had the general shape of the number seven, was placed in the bottom jaw of the Sintech tensile tester. The horizontal part of the fixture had a 0.05 mm wide slit into which the fiber could be inserted. At the end of the slit on the underside of the fixture, there was at 41° conical recess which was 0.9 mm deep to provide a recess which would accept the resin bead. This fixture was made of approximately 6 mm wide and 3 mm thick steel. The fiber with the resin bead attached was placed in the fixture so that the resin bead rested in the conical recess. The jaws of the Sintech tensile tester were then separated at the rate of 13 mm per minute while recording the force required to either cause the bead to slip along the fiber or the fiber to break. If the fiber broke, this was noted. Typically, eight replicate samples were tested. If two or more fiber samples broke in this test, the adhesion would be considered acceptable. The results of this bead test are recorded in grams/micron in Table 1 below. This is a force value for a bead break or a bead slip.

EXAMPLES 1-20, CONTROL EXAMPLES A-L

In this series of examples, the effect of UV radiation on polyethylene terephthalate polyester fibers was evaluated while varying the fiber type, fiber process finish, and pretreatment with hydrogen peroxide. After UV radiation, the treated fibers were evaluated for adhesion to a thermoset phenol-formaldehyde resin using the Resin Bead Test described above.

The polyester fibers used in all of the following examples were 50 dpf monofilaments, which were either "bright" or "dull." The "dull" fiber contained small percentages (about 0.3%) of titanium dioxide as an additive to the polyester polymer prior to melt-spinning the fiber. The "bright" fiber did not contain significant amounts of titanium dioxide or other particulate fillers, and, thus, these fibers had a lustrous surface appearance. However, bright finish polyester fibers may contain very small amounts (0.04%) of fillers, such as titanium dioxide, which function as crystallization nucleating agents. During the manufacture of melt extruded fibers, a process finish is almost always employed to facilitate handling of the fibers during manufacture and subsequent use. The following fiber finishes were used:

1) a blend of nonionic surfactants and cationic quaternary ammonium compounds commercially available from Jordan Chemical under the trade designation "JMR"; 2) a nonionic, fiber-lubricant blend of polyethylene glycol esters commercially available from Emery/Henkel under the trade designation "Emery 7451"; and 3) a blend of fatty acid ester glycerides, nonionic emulsifiers and anionic antistats commercially available from Henkel, Standard Chemical Products Division, under the trade designation "Stantex 865." The amount of fiber finish, when present, was about 1% by weight of the fiber.

The effect of pretreating the fibers with hydrogen peroxide prior to exposure to UV radiation was evaluated, and the results are reported in Table 1. The hydrogen peroxide aqueous solutions, at the concentrations indicated in Table 1, were applied with a 2-roll coater so as to lightly, but completely, wet the fibers. While the fibers were still wet, they were subjected to UV radiation.

The UV source employed was a medium-pressure, mercury-vapor lamp system having two lamps to irradiate each side of the moving web. Each lamp produced radiation at a wavelength of 200–400 nanometers (nm) in a focused band 250 mm wide, and had a power output of 124 watts per 25 mm of width. The lamps were set to a focal length of 53 mm from the lamp face. The amount of radiation was partially controlled by the exposure time and by focusing or defocusing the UV lamps at the surface to be radiated. The exposure time was adjusted to achieve the desired exposure level. The lamps are commercially available from Fusion UV Curing Systems, Rockville, Maryland. The desired amount of exposure was typically 200 to 1000 millijoules (mJ)/cm$^2$ as measured by a UV radiometer in the spectral range of 365+15 nanometers. The UV radiometer is available from EIT Inc., Sterling, Va.

A bundle of the polyester yarn, at least about one-meter long, containing about 390 filaments, each 50 dpf, were spread apart in a single layer of filaments over about a 50 mm width, and were secured with aluminum tape to a thin metal plate leader which was about 700 mm long and 230 mm wide. The metal leader was placed on the conveyer of a UV processor described above. The conveyer speed was adjusted to produce an exposure of 600 or 1000 mJ/cm$^2$.

Table 1 gives a description of the polyester fiber employed, the presence and type of fiber-process finish used, if hydrogen peroxide was used, and, if so, at what concentration was it used as pretreatment prior to exposing the test fibers to UV radiation. Table 1 also gives the evaluation results of the Fiber Breakage Test.

TABLE 1

| Example | Fiber Type | Fiber Finish | $H_2O_2$ Pre-treatment | UV MJ/CM$^2$ Total | G/ Micron | Fiber Break % |
|---|---|---|---|---|---|---|
| 1 | Bright | None | 30% | 600 | 1.44 | 25 |
| 2 | Bright | None | 30% | 1000 | 1.47 | 50 |
| 3 | Bright | None | 50% | 600 | 1.78 | 25 |
| 4 | Bright | None | 50% | 1000 | 1.57 | 38 |
| Cntrl A | Bright | None | None | None | 1.44 | 0 |
| Cntrl B | Bright | None | None | 600 | 0.97 | 0 |
| Cntrl C | Bright | None | None | 1000 | 1.26 | 13 |
| 5 | Dull | None | None | 600 | 1.27 | 25 |
| 6 | Dull | None | None | 1000 | 1.49 | 25 |
| 7 | Dull | None | 30% | 600 | 0.96 | 25 |
| 8 | Dull | None | 30% | 1000 | 1.58 | 33 |
| 9 | Dull | None | 50% | 600 | 1.48 | 50 |
| 10 | Dull | None | 50% | 1000 | 1.42 | 75 |
| Cntrl D | Dull | None | None | None | 1.51 | 0 |
| 11 | Bright | JMR | None | 600 | 2.19 | 88 |
| 12 | Bright | JMR | None | 1000 | 1.7 | 25 |
| Cntrl E | Bright | JMR | None | None | 1.39 | 0 |
| 13 | Bright | 7451 | None | 600 | 2.20 | 75 |
| 14 | Bright | 7451 | None | 1000 | 1.60 | 25 |
| Cntrl F | Bright | 7451 | None | None | 1.75 | 13 |
| Cntrl G | Bright | CX865 | None | None | 1.38 | 0 |
| Cntrl H | Bright | CX865 | None | 600 | 1.48 | 0 |
| Cntrl I | Bright | CX865 | None | 1000 | 1.34 | 0 |
| 15 | Dull | JMR | None | 600 | 2.00 | 88 |
| 16 | Dull | JMR | None | 1000 | 1.41 | 25 |
| Cntrl J | Dull | JMR | None | None | 1.41 | 0 |
| 17 | Dull | 7451 | None | 600 | 1.23 | 25 |
| 18 | Dull | 7451 | None | 1000 | 1.46 | 25 |
| Cntrl K | Dull | 7451 | None | None | 1.48 | 0 |
| 19 | Dull | CX865 | None | 600 | 1.39 | 25 |
| 20 | Dull | CX865 | None | 1000 | 1.44 | 50 |
| Cntrl L | Dull | CX865 | None | None | 1.39 | 0 |

Examples 1-4 were bright polyester (no finish) treated with about a 30%-50% solution of hydrogen peroxide prior to UV exposure The results indicate that with no finish on the surface, the higher the intensity, the higher the percent fiber breakage.

Controls A, B, and C demonstrate that for bright fibers with no hydrogen peroxide and no fiber finish the adhesion is not enhanced even at higher UV intensity.

Control D is a dull polyester fiber with no finish, no hydrogen peroxide treatment, and no UV treatment. Control D resulted in a fiber with no enhanced adhesion.

Examples 5-10 were dull polyester fibers (no finish) treated with about a 30%-50% solution of hydrogen peroxide prior to UV exposure. The examples showed enhanced adhesion when compared to Control D.

Examples 11 and 12 were bright polyester fibers with the "JMR" fiber finish applied prior to UV exposure. The optimum adhesion was shown at 600 mJ/cm$^2$.

Control E shows that the finish has no effect on adhesion enhancement unless the fiber has been UV treated.

Examples 13 and 14 again show that optimum adhesion occurs at an irradiation of 600 mJ/cm$^2$ when the "Emery 7451" finish was used.

Control F, a bright polyester fiber, shows that with no UV exposure the "Emery 7451" fiber finish did not enhance phenolic resin adhesion to the fiber.

Controls G, H, and I are bright polyester fibers with a "Stantex 865" finish and no hydrogen peroxide pretreatment. There was inadequate adhesion even at higher UV intensities.

Examples 15 and 16 were dull polyester with a "JMR" fiber finish. As shown with the bright polyester fibers, the best adhesion was at 600 mJ/cm$^2$.

Control J was a dull polyester fiber with a "JMR" finish and no UV exposure. The resultant fiber had poor adhesion.

Examples 17 and 18 were dull polyester fibers with a "Emery 7451" fiber finish. The adhesion was only minimally enhanced at 600 mJ/cm$^2$ as compared to the same finish on bright polyester fibers.

Control K shows that no finish and no UV irradiation resulted in poor phenolic adhesion to the polyester fibers.

Examples 19 and 20 were dull polyester fibers with a "Stantex 865" finish. These fibers, after UV irradiation at 1000 mJ/cm$^2$, showed enhanced adhesion. This is in comparison to Control L, which had no enhanced adhesion.

Control L, a dull polyester with "Stantex 865" finish and no UV irradiation, had no enhanced adhesion The overall results from Table 1 illustrate that the effect of UV irradiation on phenolic adhesion varies with the base fiber type (dull or bright), fiber finishes, and hydrogen peroxide treatments. The dull polyester fiber performed well without hydrogen peroxide treatment. The bright fibers were required to have a hydrogen peroxide treatment except when a fiber finish of a nonionic lubricant blend of polyethylene glycol esters was used. Further, when a "JMR" fiber finish was utilized on the fibers, both fiber types had good adhesion without hydrogen peroxide pretreatment. Other differences related to fiber finish were also detected such as the "Stantex 865" finish resulted in no enhanced adhesion when used on bright fibers, yet "Stantex 865," used on dull fibers with high intensity UV radiation, resulted in enhanced adhesion.

EXAMPLES 21-31

In these series of examples, a nonwoven web weighing 125 g/m$^2$, consisting of 75% 15 dpf polyethylene terephthalate fiber (PET) and 25% 15 dpf thermo-bonding fiber, was manufactured by 3M in accordance with the teaching of Assignee's U.S. Pat. No. 5,082,720. The 15 dpf PET fibers were bright fibers with a nonionic-/anionic based finish. The 15 dpf thermo-bonding fibers were semi-dull, also with a nonionic/anionic based finish. This nonwoven web was formed on a Rando Webber, commercially available from Curalator Corp., Macedon, N.Y. 14502. The web was subsequently passed through an oven at 175° C. at the rate of 1.5 meter/minute to cause activation of the thermo-bonded fibers. The thermo-bonded fiber web was then subjected to a hydrogen peroxide pretreatment as indicated in Table 2, etc. Examples 21–26 have no pretreatment. Examples 27–31 had a 3% aqueous hydrogen-peroxide pretreatment where a sufficient amount of hydrogen-peroxide solution was roll coated on the web to wet the thermo-bonded web. The thermo-bonded web, with or without the hydrogen-peroxide treatment as designated, was then passed through the UV processor treatment apparatus, described above, at a rate to cause the radiation intensity to be at levels of about 200 to 1,000 mJ/cm$^2$.

The UV exposed web was then coated, using a 2-roll coater with a pigmented solution of a thermoset base catalyzed phenol-formaldehyde resin comprised of 55% phenolic resin containing 70% solids, 8% isopropyl alcohol, approximately 3% pigments, and the balance water. The coated web was then cured at 165° C. at the rate of 2.1 m/min. to yield a web containing 85 g/m$^2$ of added dried and cured resin. The resin-bonded web was then spray-coated on both sides per the teaching of Hoover, U.S. Pat. No. 2,958,593, with a phenolic resin slurry which contained 23% thermoset base catalyzed phenol-formaldehyde resin containing 70% solids, 2% isopropyl alcohol, approximately 3% pigments, 10% calcium carbonate filler, 50% grade 240 and finer aluminum oxide abrasive particles, and the balance water. This coating was uniformly applied by spraying on both sides to yield a finished product which, after curing at 165° C. for 10 minutes, yielded a nonwoven abrasive web which weighed approximately 560 g/m$^2$. The resultant coated web was cut into 64 by 190 mm pieces and evaluated as described below in the wear test.

CONTROL EXAMPLE M

Control Example M was prepared in the same way as described above for Examples 21–31, with the exception that the polyester fiber was not subjected to a pretreatment of hydrogen peroxide or exposed to a source of UV radiation.

WEAR TEST

A 64 by 190 mm sample of the Examples 11–21 and Control M were evaluated for durability. In this test, the sample was rubbed against an abrasive surface with the percent weight loss noted after the test. A lower percent weight loss indicated a more durable product. The 64 by 190 mm sample of test material was secured to an abrasion boat of a Gardner Straight Line Washability and Wear Test, an abrasion test machine. The abrasion boat and an added weight weighed a total of 2.4 kg. The test sample was abraded against a 320 grade screen mesh abrasive material commercially available from 3M Company under the trade name "Fabricut." The sample was rubbed back and forth in a horizontal fashion (one cycle), over a distance of 340 mm for 200 cycles. The sample was weighed both before and after the test and the weight percent loss was calculated. These values are recorded in Table 2 below. Wear percentages less than about 80 were considered to have improved adhesion.

HYDROXYLATION RATIO

The webs of Examples 21–31 were evaluated to obtain degree of hydroxylation per the method described in the *Journal of Polymer Science*, Part B, Vol. 7, pp. 7–9, 1969. The hydroxylation ratio, as indicated in Table 2, was measured after UV radiation and pretreatment of hydrogen peroxide, but prior to application of coatings to make nonwoven abrasive structures. The samples were analyzed using a Fluorlog 2 Series Spectrofluorometer to determine the emission spectra of the samples. The spectrum between 400 and 500 nanometers was observed and recorded. A peak at 467 nanometers is indicative of hydroxylation of the aromatic ring in the polyester polymer. The ratio of the peak intensity at 467 nanometers to the intensity at 418 nanometers yielded the Hydroxylation Ratio. Increasing UV irradiation increases the Hydroxylation Ratio, and pretreatment with hydrogen peroxide significantly further increases this ratio. Results are given in Table 2.

TABLE 2

| Example | Fiber | Pre-treatment | UV MJ/CM$_2$ | % Wear | Hydroxylation Ratio |
|---|---|---|---|---|---|
| 21 | PET | None | 600 | 40,36 | 0.330 |
| 22 | PET | None | 200 | 63 | 0.271 |
| 23 | PET | None | 400 | 47 | 0.295 |
| 24 | PET | None | 600 | 42 | 0.330 |
| 25 | PET | None | 800 | 71 | 0.377 |
| 26 | PET | None | 100 | 49 | 0.383 |
| 27 | PET | $H_2O_2$, 3% | 200 | 52 | 0.705 |
| 28 | PET | $H_2O_2$, 3% | 400 | 39 | 0.703 |
| 29 | PET | $H_2O_2$, 3% | 600 | 40 | 0.987 |
| 30 | PET | $H_2O_2$, 3% | 800 | 65 | 1.219 |
| 31 | PET | $H_2O_2$, 3% | 100 | 59 | 1.000 |
| Control M | PET | None | None | 80 | 0.218 |

For all examples in Table 2, the enhanced adhesion is measured by the decrease in percent wear of the UV irradiated web as compared to a web that did not receive any UV radiation treatment (Control M). The lower the percent wear, the better the adhesion of the phenolic resin to the polyester fiber.

Examples 21–26 were polyester webs irradiated at intensities in the range of 200 mJ/cm$^2$–1000 mJ/cm$^2$. The percent wear decreased as the intensity increased to 600 mJ/cm$^2$. Then between 600 mJ/cm$^2$ and 800 mJ/cm$^2$, the percent wear began to increase, followed by another decrease between 800 mJ/cm$^2$ and 1000 mJ/cm$^2$.

Examples 27–31 were polyester webs coated with 3% hydrogen peroxide before UV irradiation. The UV irradiation was again in the range between 200 mJ/cm$^2$ and 1000 mJ/cm$^2$. Percent wear decreased with increasing intensity. The addition of the hydrogen peroxide shifted the lower percent wear values down into the lower intensity range, which widened the effective window of irradiation. Again, the percent wear increased between 600 mJ/cm$^2$ and 800 mJ/cm$^2$. Then percent wear decreased between 800 mJ/cm$^2$ and 1000 mJ/cm$^2$.

Control M was a polyester web that has not been UV irradiated.

The results of Table 2 indicate, among other things, that the percent wear minimizes at an intensity of about 600 mJ/cm$^2$. The percent wear also decreases with fibers that have been exposed to hydrogen peroxide solution.

The results of Table 2 show that the optimum adhesion of phenolic to UV treated polyester was attained at 400 mJ/cm$^2$–600 mJ/cm$^2$. However, all UV irradiated webs performed better than Control M. There was some indication that a second optimum intensity window exists above 800 mJ/cm$^2$. However, irradiation above 800 mJ/cm$^2$ is not considered commercially feasible due to the cost of irradiating samples at such a high intensity.

The hydroxylation ratio column shows that as intensity increases the hydroxylation of the polyester fiber increases. While the actual hydroxylation ratio cannot be used to indicate the limiting amount of hydroxyls needed for improved wear performance, it can be used to study the extent of surface modification after UV irradiation.

In view of the foregoing description, it will be apparent that the invention is not limited to the specific details set forth herein for purposes of illustration, and that various other modifications are equivalent for the stated and illustrated functions without departing from the spirit of the invention and the scope thereof as defined in the appended claims.

What is claimed is:

1. A surface finishing article comprising:

(a) a nonwoven, three-dimensional, open, lofty web of polyester fibers, said polyester being selected from the group consisting of polyester having a dulling agent blended therein and polyester which is substantially free of dulling agent, wherein if said polyester is substantially free of dulling agent, then said polyester fibers are coated with a material selected from the group consisting of hydrogen peroxide, a fiber finish, or combination thereof, said fibers having been exposed to UV radiation of at least about 200 mJ/cm$^2$ and at most about 1000 mJ/cm$^2$ subsequent to any treatment with said material; and (b) a phenol-formaldehyde resin which substantially bonds said fibers at points of mutual contact.

2. The article of claim 1 wherein said polyester fibers comprise substantially polyethylene terephthalate.

3. The article of claim 1 wherein said resin comprises abrasive particles.

4. The article of claim 1 wherein adhesion between said phenol-formaldehyde resin and said polyester fibers results in at least 25% of fiber breakage when a single drop of said resin is cured on said fiber and said drop is pulled in a longitudinal direction until either said drop slips along said fiber or said fiber breaks.

5. The article of claim 1 wherein said article has a percent wear of less than about 80%.

6. The article of claim 1 wherein said dulling agent is titanium dioxide.

7. A surface finishing article comprising:

(a) a nonwoven, three-dimensional, open, lofty web of polyester fibers comprised of polyester having a dulling agent blended therein, said polyester fibers having been exposed to UV radiation of at least about 200 mJ/cm$^2$ and at most about 1000 mJ/cm$^2$; and (b) a phenol-formaldehyde resin which substantially bonds said fibers at points of mutual contact.

8. A surface finishing article comprising:

(a) a nonwoven, three-dimensional, open, lofty web of polyester fibers comprised of polyester which is substantially free of dulling agents, said polyester fibers having been first coated with a material selected from the group consisting of a fiber finish, hydrogen peroxide, or combination thereof, and then exposed to UV radiation of at least about 200 mJ/cm$^2$ and at most about 1000 mJ/cm$^2$; and (b) a phenol-formaldehyde resin which substantially bonds said fibers at points of mutual contact.

* * * * *

UNITED STATES PATENT AND TRADEMARK OFFICE

CERTIFICATE OF CORRECTION

PATENT NO. : 5,227,229

DATED : July 13, 1993

INVENTOR(S) : Kay McMahan McCoy et al.

It is certified that error appears in the above-identified patent and that said Letters Patent is hereby corrected as shown below:

| | |
|---|---|
| Cover Page, under "ABSTRACT": Line 5 | "resin binder A" should be --resin binder. A-- |
| Col. 3, line 23 | "poly(phenol-for-aldehyde)" should be --poly(phenol-formaldehyde)-- |
| Col 3, line 35 | "by However et al." should be --by Hoover et al.-- |

Signed and Sealed this

Twenty-fourth Day of May, 1994

Bruce Lehman

*Attest:*

BRUCE LEHMAN

*Attesting Officer*

*Commissioner of Patents and Trademarks*